United States Patent [19]

Chu

[11] Patent Number: 4,877,384

[45] Date of Patent: Oct. 31, 1989

[54] VANE TYPE ROTARY COMPRESSOR

[76] Inventor: Jen-Yeh Chu, No. 75-2, Feng Jen Street, Chi-Lung City, Taiwan

[21] Appl. No.: 194,964

[22] Filed: May 16, 1988

[51] Int. Cl.[4] ..... F04C 15/02; F04C 29/08

[52] U.S. Cl. ..... 418/184; 418/188

[58] Field of Search ..... 418/184, 188, 183

[56] References Cited

U.S. PATENT DOCUMENTS

| | | | |
|---|---|---|---|
| 2,475,224 | 7/1949 | Deitrickson | 418/184 |
| 4,073,343 | 6/1987 | Moore | 418/185 |

FOREIGN PATENT DOCUMENTS

| | | | |
|---|---|---|---|
| 2536800 | 6/1984 | France | 418/184 |
| 180791 | 10/1983 | Japan | 418/184 |

*Primary Examiner*—Carlton R. Croyle
*Assistant Examiner*—Timothy S. Thorpe
*Attorney, Agent, or Firm*—Notaro & Michalos

[57] ABSTRACT

A vane-type rotary compressor comprises a cylinder which receives an axially mounted rotor. A shaft end connected to the rotor carries a groove which registers with holes provided in an axially slidable ring. The ring slides axially within a central cavity in an end plate fixed to the cylinder. The end plates carries radial passages for communication with the holes in the ring. One hole for expelling gas from chambers defined by radially movable vanes in the rotor, always communicates with an arc-shaped groove on the plate through one of the holes in the ring. This is despite the axial position of the ring. Two other holes are provided in the ring near opposite axial ends of the ring for varying amounts of overlap with a discharge an an unloading passage. In this way with the ring at one axial end of its stroke, all of the gas is discharged while at the opposite end of the stroke all of the gas is supplied to the unloading passage. The unloading passage communicates with a subsequent compression chamber around the rotor.

5 Claims, 3 Drawing Sheets

VANE TYPE ROTARY COMPRESSOR

FIELD AND BACKGROUND OF THE INVENTION

The conventional vane-type rotary compressor is advantageous because of its simple mechanism and low manufacturing cost. This does not explain why no ideal high capacity vane-type compressor has been developed. The following facts are the real reasons why no ideal high capacity vane-type compressor has been developed:

1. The reed-type discharge valve needed in such compressors, cannot work at high frequency.
2. A large pressure drop is induced by the reed-type disc in the fast gas flow of such a compressor.
3. Several discharge actions are performed for each of the multi-vane type rotor.

SUMMARY OF THE INVENTION

Discarding the conventional reed-type discharge value, the present invention utilizes a new gas-governed mechanism, which can well match the speedy gas discharging action of a vane-type compressor. In this way the compressor of the invention can not only overcome the mentioned problem throughly, but also produce the compressed gas without pressure surging, and can be controlled to its full-range of capacity easily.

All of the merits of this invention become apparent from the following detailed description.

BRIEF DESCRIPTION OF THE DRAWINGS

FIG. 1 is a perspective exploded view of a vane-type rotary compressor according to this invention;

DESCRIPTION OF THE PREFERRED EMBODIMENT

Figure 7:
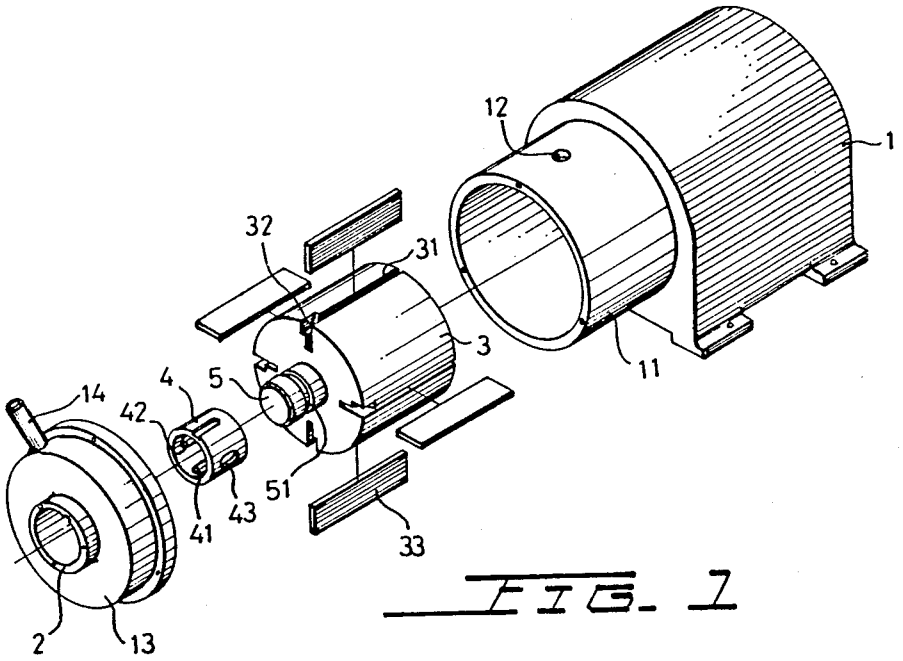
Figure 2:
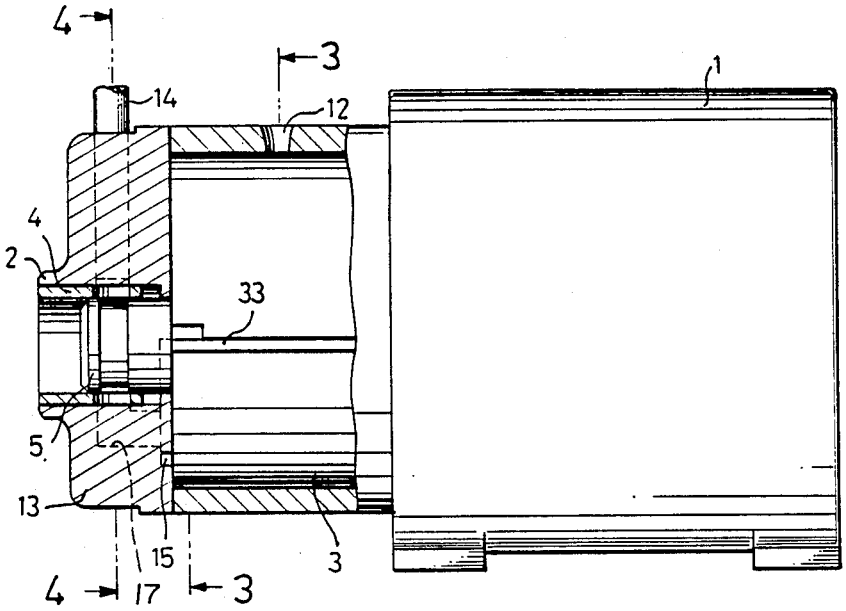
FIG. 2 is a cross-sectional view of a vane-type rotor according to this invention.
Figure 3:
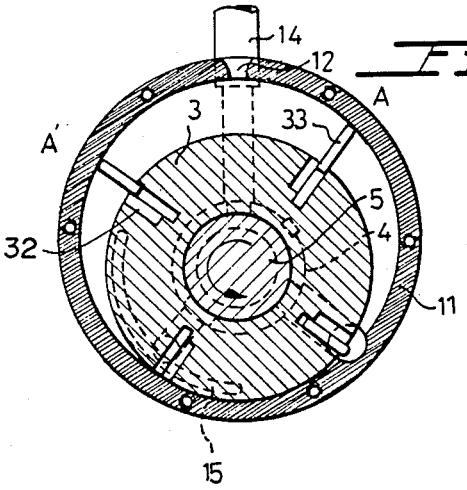
FIG. 3 is a cross-sectional view along line 3—3 of FIG. 2.

Reference is now made to FIGS. 1-5, illustrating the embodiment of the present invention. As shown in FIGS. 1 and 2, the present invention employs an electrical motor 1 as a power source which rotates a rotor 3. A shaft end 5 extends from the rotor 3. A cylinder 11 is eccentrically mounted to the housings of motor 1, in an eccentric position having a center above the center of rotor 3. A gas inlet 12 is provided at the top dead center of cylinder 11. Four evenly spaced slots 31 are provided in the exterior cylindrical surface of rotor 3. Movable vanes 33 are slidably mounted in the slots 31. A notch 32 is provided on the leading outer edge of each slot 31, in the rotation direction of rotor 3. An annular groove 51 is cut into the shaft end, and is covered by a sliding ring 4 having three holes 41,42,43 in its wall. Ring 4 with shaft end 5 therein, is seated in an end plate 13 mounted over the open end of cylinder 11 (FIG. 2). Ring 4 can be adjusted axially by an attached linkage (not shown) in the hub 2 of plate 13. The sliding ring 4 encloses the shaft end, with its holes aligned with the annular groove on the shaft end. There are three radial passages 14, 16 and 17 in the end plate 13, (detail shown in FIG. 4) going to the cavity. On the inner flat surface of the end plate 13, there is provided an arc-shaped groove 15 with a hole drilled to the passage 17 that acts as an expelling gas passage (FIG. 3). Another hole is drilled to the unloading gas passage 16. In any axial position of ring 4, its hole 41, acting as an expelling hole on the sliding ring, overlaps the interior port of passage 17 by 100%. this means that the expelling passage is always fully free in this "expelling overlap" condition.

Unloading hole 43 overlaps the interior port of unloading passage 16 only partially, so that the passage is not completely blocked. This "unloading overlap" condition is 0-100%. Discharge hole 42 overlaps the interior port of discharge passage 14 only partially, so that the passage of gas is not completely free. This means that the "discharging overlap" condition is 0-100%.

Figure 4:
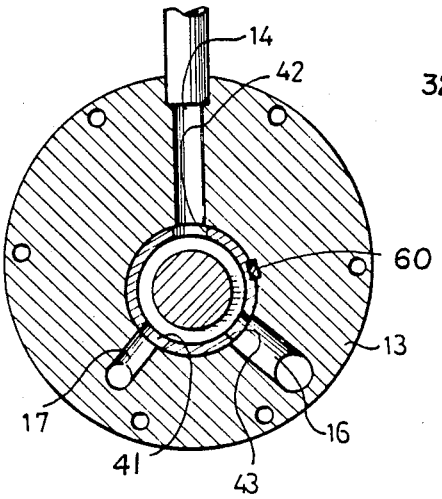
FIG. 4 is a cross-sectional view along line 4—4 of FIG. 2.

Ring 4 axially slides in the hub cavity 2 but is fixed against rotation to plate 13 by a key 60 (see FIG. 4). Expelling hole 41 is axially elongated or large as shown in FIG. 1 and holes 42 and 43 are round and positioned near opposite axial ends of the ring 4.

Figure 5:
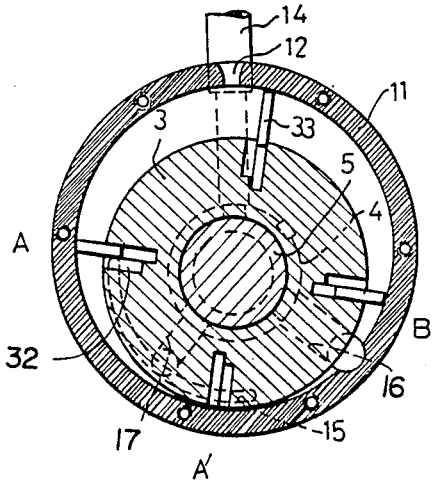
FIG. 5 is a cross-sectional view similar to FIG. 3 showing the rotation of the rotor to a certain angle.

Reference is now made to FIGS. 3 to 5, illustrating the internal structure of the end plate 13, which is screwed externally to the cylinder 11, in order to contain all the moving parts including the rotor and vanes.

In operation, the rotor 3 is rotated by the motor 1. Centrifugal force forces the vanes outwardly against the inner surface of cylinder 11 as shown in FIGS. 3 to 5. The outer edges of vanes 33 always contact the inner surface so that four compartments will be formed at any moment. The compartment between vane positions A and A' in FIG. 3 will be sealed closely at an initial pressure, after the trailing vane A sweeps over the gas inlet 12 as rotor 3 rotates in the direction of the arrow. The volume of compartment AA' decreases as the rotor rotates and pressure therein rises gradually. Once the rotor rotates by a certain angle, into the position of FIG. 5, the pressure in AA' is already much higher than the exhaust back pressure, the notch 32 in front of the trailing vane A is going to engage the arc shaped groove 15 on the end plate 13 at this moment, and the compressed gas in the compartment AA' starts to the expelled through passage 17, which communicates with groove 15. If the axial position of sliding ring 4 is fully in toward rotor 3, the "discharging overlap" is 100% and the "unloading overlap" is zero. the "expelling overlap" is always 100%. All the compressed gas will be completely purged to the discharge passage 14 (i.e. the outlet piping). If the axial position of ring 4 is at the outward end (FIG. 2), the "discharging overlap" is zero and the "unloading overlap" is 100%. All the compressed gas in AA' will then be purged to another closed compartment A'B (FIG. 5) which has a volume that is becoming larger with rotation of rotor 3. The compressed gas will thus expand and exert a force on the rotor in the rotational direction to offset the energy needed for compressing the gas. If the sliding ring is at any position other than the above extreme ends, only partial overlap of the gas ports will result, for example, 70% of the "discharging overlap" with 30% of the "unloading overlap". This will almost proportionally decrease the discharging gas quantity. With capacity thus decreasing, so does the load on the motor. The full range of capacity control will thus be achieved easily by adjusting the position of the sliding rings.

The angle of the arc-shaped groove 15 shown in FIGS. 3 and 5, is larger than 90°. For a four-vane compressor, not until the previous gas exhaling step ends, does the subsequent exhaling step start again. In this way, there is no interruption of the discharging action. The compressor will produce compressed gas without pressure surging.

From the above drawings and description the relative arrangement of parts of this invention and its function, should be easily understood to those skilled in the mechanical arts.

I claim:

1. A vane-type rotary compressor comprising;

a cylinder (11) having an upper gas inlet (12) at a selected location in its circumference;

a rotor (3) eccentrically mounted in a lower portion of said cylinder spaced away from said gas inlet, said rotor having a plurality of circumferentially spaced radial slots therein, each slot having a notch near an outer end thereof on a leading side of said slot in a direction of rotation of said rotor;

motor means connected to said rotor for rotating said rotor in the rotational direction;

a vane (33) slidably mounted in each of said slots, each vane being slidable outwardly against an inner surface of said cylinder for defining gas chambers between said vanes and between an outer surface of said rotor and the inner surface of said cylinder;

an end plate (13) fixed to and closing said cylinder, said end plate having an arc shaped groove (15) in a position to be covered by an end surface of said rotor, said arc shaped groove being in the path of said notches with rotation of said rotor, said end plate having a hub cavity (2) which is centered with a center of rotation for said rotor, said end plate including a discharging passage communicating with said cavity, an unloading passage communicating with said cavity and an expelling passage communicating with said cavity, said passages being circumferentialy spaced around said cavity;

a sliding ring (4) mounted for axial movement in said cavity, said sliding ring being fixed against rotation to said end plate, said sliding ring having a discharging hole (42) therethrough at one axial end of said ring, an unloading hole (43) therethrough at on opposite axial end of said ring, and an expelling hole (41) therethrough which is large enough to always be in communication with said arc shaped groove despite the axial position of said ring, said expelling hole always overlapping 100% of said expelling passage despite the axial position of said ring, said discharging hole overlapping by between 0 and 100% of said discharging passage depending on the axial position of said ring and said unloading hole overlapping by 100% to 0% of said unloading passage depending on the axial position of said ring, said unloading passage being 100% overlapped by said unloading hole when said discharging passage is 0% overlapped by said discharging hole; and a shaft end (5) connected to said rotor and extending outwardly from the center of rotation of said rotar into sliding contact with an inner surface of said ring, said shaft end having an annular groove (51) therein for establishing communication between said holes of said ring.

2. A compressor according to claim 1 including four slots with four vanes therein, said arc shaped groove having a length of slightly more than 90°.

3. A compressor according to claim 2 wherein each of said passages extend at least partly radially in said end plate.

4. A compressor according to claim 3 wherein said motor means comprises an electric motor.

5. A compressor according to claim 4 wherein said expelling hole is axially elongated and each of said discharging and unloading holes are circular.

* * * * *